US007029769B2

(12) United States Patent
Tajima et al.

(10) Patent No.: US 7,029,769 B2
(45) Date of Patent: Apr. 18, 2006

(54) INSULATION FILM, POWDER FOR MAGNETIC CORE AND POWDER MAGNETIC CORE AND PROCESSES FOR PRODUCING THE SAME

(75) Inventors: Shin Tajima, Nagoya (JP); Takeshi Hattori, Aichi-gun (JP); Mikio Kondoh, Toyoake (JP); Kiyoshi Higashiyama, Toyota (JP); Hidefumi Kishimoto, Toyota (JP); Masaki Sugiyama, Tokyo-to (JP); Tadayoshi Kikko, Tokyo-to (JP)

(73) Assignees: Kabushiki Kaisha Toyota Chuo Kenkyusho, Aichi-gun (JP); Toyota Jidosha Kabushiki Kaisha, Toyota (JP); Finesinter Co., Ltd., Tokyo-to (JP)

( * ) Notice: Subject to any disclaimer, the term of this patent is extended or adjusted under 35 U.S.C. 154(b) by 255 days.

(21) Appl. No.: 10/389,978

(22) Filed: Mar. 18, 2003

(65) Prior Publication Data

US 2003/0230362 A1 Dec. 18, 2003

(30) Foreign Application Priority Data

Mar. 20, 2002 (JP) ..... 2002-079327

(51) Int. Cl.
*B22B 9/04* (2006.01)

(52) U.S. Cl. ..... 428/704; 428/457; 428/472.3; 148/306; 148/104; 148/105; 148/261; 148/262; 148/263; 419/64; 419/66; 427/127

(58) Field of Classification Search ..... 428/457, 428/472.3, 704; 148/306
See application file for complete search history.

(56) References Cited

U.S. PATENT DOCUMENTS

2002/0034453 A1 3/2002 Kondo et al.

FOREIGN PATENT DOCUMENTS

| | | |
|---|---|---|
| JP | 6-132109 | 5/1994 |
| JP | 6-260319 | 9/1994 |
| JP | 7-245209 | 9/1995 |
| JP | 8-167519 | 6/1996 |
| JP | 2000-504785 | 4/2000 |
| JP | 2002-508442 | 3/2002 |
| WO | WO 02/058085 | 7/2002 |

OTHER PUBLICATIONS

U.S. Appl. No. 09/927,323, filed Aug. 13, 2001, Kondo et al.
U.S. Appl. No. 10/389,978, filed Mar. 18, 2003, Tajima et al.
U.S. Appl. No. 10/466,101, filed Jul. 18, 2003, Kondo et al.

*Primary Examiner*—John P. Sheehan
(74) *Attorney, Agent, or Firm*—Oblon, Spivak, McClelland, Maier & Neustadt, P.C.

(57) ABSTRACT

An insulation film whose requisite constituent elements are first elements and a second element. The first elements include B, P, O and Fe. The second element can generate cations whose hexa-coordinated ion radius, defined by Shannon, R. D., is 0.073 nm or more, and which are bivalent or more. Since the second element having a large ion radius is incorporated into network formers made from the first elements, it is possible to improve the heat resistance of the insulation film.

28 Claims, 1 Drawing Sheet

INSULATION FILM, POWDER FOR MAGNETIC CORE AND POWDER MAGNETIC CORE AND PROCESSES FOR PRODUCING THE SAME

BACKGROUND OF THE INVENTION

1. Field of the Invention

The present invention relates to an insulation film which is good in terms of the heat resistance, a powder for a magnetic core, powder which is covered with the insulation film, a powder magnetic core which is composed of the magnetic powder, and processes for producing them.

2. Description of the Related Art

Around us, there are many articles, such as transformers, motors, generators, speakers, induction heaters and a variety of actuators, which utilize electromagnetism. Many of these articles utilize alternating magnetic fields. In order to efficiently produce alternating magnetic fields which are great locally, magnetic cores (or soft magnets) are usually disposed in the alternating magnetic fields.

From the nature of the characteristics, those magnetic cores are first required to produce a large magnetic flux in alternating magnetic fields. Next, when they are used in alternating magnetic fields, they are required to exhibit less iron loss which is generated in accordance with the frequencies of the alternating magnetic fields. As the iron loss, there are eddy current loss, hysteresis loss and residual loss. Among them, however, the eddy current loss and the hysteresis loss matter mostly. Moreover, in order that magnetic cores follow magnetic fields to produce high magnetic flux density, it is important as well that their coercive forces are small. Note that it is possible to improve (initial) magnetic permeability and reduce hysteresis loss at the same time by reducing the coercive forces.

However, it is difficult to simultaneously satisfy those requirements. Not to speak of simple iron cores, but conventional cores in which thin silicon steel plates are laminated have not produced sufficient performance. Accordingly, it has been a trend recently to solve the problems by using powder magnetic cores which are formed by pressurizing magnetic powders (or magnetic core powders) covered with insulation films. Specifically, the respective particles of magnetic powders are covered with insulation films to enlarge the specific resistance, and thereby the iron loss of powder magnetic cores is reduced. At the same time, such powders are formed with high pressures to produce powder magnetic cores with a high density, and thereby it is intended to enlarge the magnetic flux density. Such a powder magnetic core is disclosed in PCT International Laid-Open Publication No. 2000-504,785, for example. According to the publication, a pure iron powder being a magnetic powder is contacted with a phosphoric acid solution to generate an insulation film being composed of a phosphate (or iron phosphate) film on a surface of the pure iron powder. The resulting powder is formed by pressurizing to make a powder magnetic core.

However, it is not yet possible to say that powder magnetic cores so far have had sufficient performance. The reasons are as follows. Above all, since magnetic powders are formed at low pressures, which are determined while taking the longevity, and the like, of molds into consideration, the resulting conventional powder magnetic cores have a low density so that they cannot produce a sufficiently high magnetic flux density.

Yet, the applicants (or assignees) of the present invention have been already solved in this regard. That is, they have already developed technologies which make it possible to form magnetic powders with super high pressures, and have succeeded in producing powder magnetic cores, which are highly densified approximately to the true density, from magnetic powders which are covered with insulation films. Moreover, they have already filed a plurality of patent applications for the technologies.

Another reason why the performance of conventional powder magnetic cores is insufficient is that the iron loss cannot be reduced sufficiently by simply disposing insulation films on a surface of magnetic powders. Specifically, among the iron loss, in particular, the eddy current loss has been reduced so far by enlarging the specific resistance mostly. Accordingly, it has not been intended so much to reduce the hysteresis loss itself. Of course, the hysteresis loss does not matter in powder magnetic cores which are used in a frequency range (or a super high frequency range) where the hysteresis loss is negligible compared with the eddy current loss. However, many articles are often used in a frequency range of some hundreds Hz or less, for example. In such a frequency range, it is not possible to ignore even the hysteresis loss in powder magnetic cores.

As described above, in order to reduce the hysteresis loss in powder magnetic cores, it is effective to reduce the coercive force of powder magnetic cores. The coercive force is influenced by strain which resides in the particles of magnetic powders. The greater the strain is, the greater the coercive force is. In view of producing powder magnetic cores, it is inevitable that residual strain arises more or less in the particles of magnetic powders after they are formed by pressurizing. Therefore, in order to reduce the hysteresis loss, it is necessary to remove the residual strain which arises once in the particles of magnetic powders. In order to remove the residual strain, it is effective to subject powder magnetic cores to a heat treatment such as annealing for removing residual stress.

The heat treatment depends on the types of magnetic powders. However, in the case of ordinary magnetic powders in which Fe is a major component, it is desirable to heat them at 450° C. or more, further to about 500° C., to fully remove the strain residing in them.

However, when powder magnetic cores are heated to such high temperatures, the resinous films, which have been used conventionally as insulation films for magnetic powders, are decomposed to disappear. Even the above-described phosphate film (or chemical film) crystallizes to cause sintering and agglomerating. Thus, it has become apparent that the crystallized phosphate films concentrate at the spaces (or triple point) formed among the particles of magnetic powder, and magnetic powders react with insulation films to destroy insulation films. When such is the case, the specific resistance is reduced sharply to enlarge the eddy current loss, and to adversely result in increasing the iron loss. Thus, it is meaningless to carry out the heat treatment. Here, it is possible to think of using oxide-based, such as $SiO_2$, $Al_2O_3$, $ZrO_2$ and $TiO_2$-based, insulation films whose relatively heat resistance is high. However, it is difficult technically to coat a thin oxide film whose thickness is some dozens of nanometers on magnetic powders without pinholes. Moreover, since the costs are high remarkably, such a method is not effective industrially. On the other hand, when the oxide-based films are thickened to 100 nm or more, such a method is not preferable after all because the resulting powder magnetic cores exhibit a lowered magnetic flux density.

Hence, in Japanese Unexamined Patent Publication (KOKAI) No. 6-132,109 and Japanese Patent Publication No. 2,710,152, for example, there are disclosures about glassy insulation layers in which chromium (Cr) and magnesium (Mg) are requisite constituent elements to enhance the heat resistance.

However, as set forth in Japanese Patent Publication No. 2,710,152, it is not preferable to use Cr in view of environment. Moreover, according to the survey and study conducted by the present inventors, it seemed that the glassy insulation layers in which Mg is a requisite constituent element were surely improved in terms of the heat resistance compared with conventional ones. However, the heat resistance was not yet sufficient at all.

SUMMARY OF THE INVENTION

The present invention has been developed in view of such circumstances. It is therefore an object of the present invention to provide an insulation film, which can improve the heat resistance of powder magnetic cores, and a process for producing the same. Further, it is another object of the present invention to provide a magnetic core powder, magnetic core powder which comprises a magnetic powder covered with the insulation film, and a process for producing the same. Furthermore, it is still another object of the present invention to provide a powder magnetic core, which is produced by using the powder for a magnetic core, and a process for producing the same.

Note that the cases described so far exemplify removing residual strains (stress relief) in magnetic powders for the purpose of improving the heat resistance of insulation films. However, the present invention is not limited thereto. For example, even when no heat treatment, such as annealing, is not carried out, it becomes possible to stably use magnetic cores, and the like, in an elevated temperature range by upgrading the heat resistance of insulation films in accordance with the present invention.

Hence, the present inventors studied wholeheartedly to achieve the objects. As a result of repetitive trials and errors, they newly discovered that, when insulation films are used in which elements having a relatively large ion radius are requisite constituent elements, it is possible to improve the heat resistance. Thus, they arrived at completing the present invention.

Insulation Film

For example, an insulation film according to the present invention comprises B, P and O; and a second element capable of generating cations whose hexa-coordinated ion radius, defined by Shannon, R. D., is 0.073 nm or more, and which are bivalent or more; are requisite constituent elements. Note that, when Fe is a major component in magnetic powders, the first element groups include Fe, which mingles from the magnetic powders during covering treatments, in addition to the B, P and O. Specifically, the present insulation film can preferably comprise the first group elements (e.g., B, P, O and Fe) in a summed amount of from 80 to 99% by mole, and the second element in an amount of from 2 to 20% by mole with respect to the entire present insulation film taken as 100% by mass. Note that a summed amount of the first group elements and the second element shall not exceed 100% by mole in total. More specifically, the content of B can preferably fall in a range of from 1 to 10% by mole, the content of P can preferably fall in a range of from 5 to 30% by mole, the content of O can preferably fall in a range of from 40 to 80% by mole, and the content of Fe can preferably fall in a range of from 1 to 20% by mole with respect to the entire present insulation film taken as 100% by mole.

It has been verified that the present insulation film, which is composed of the first elements, comprising B, P and O (additionally Fe), and the second element, reveals good heat resistance. The reasons why the present insulation film reveals good heat resistance have not necessarily been cleared at present. However, it is possible to believe that the present insulation film reveals good heat resistance in the following manner.

First of all, how the present inventors completed the present insulation film will be hereinafter described. The present inventors first surveyed the phosphate film which is set forth in the above-described publication, PCT International Laid-Open Publication No. 2000-504,785. The phosphate film was composed of P—Fe—O amorphous films, and could form a thin and uniform film. Above all, the phosphate film could be formed industrially at low costs, and was a good insulation film regarding the feature. However, when powder magnetic cores, which were made from magnetic powders covered with the phosphate film, were annealed in order to remove residual strain, it was confirmed that the specific resistance of the powder magnetic cores reduced sharply if the treatment temperature exceeded 400° C. The phenomenon is believed to result from the fact that the phosphate film, which is amorphous inherently, is destroyed to crystallize, and the crystallized phosphate films cause sintering and agglomeration so that they concentrate at the spaces (or triple points) formed among the particles of magnetic powders.

Next, instead of phosphoric acid, an insulation film, which was composed of borate-phosphate, was generated by using boric-phosphoric acid (or boric acid and phosphoric acid), and was examined for the heat resistance in the same manner as the phosphate film. Similarly to the phosphate film, the borate-phosphate film was also good in that it was likely to form a uniform thin film. However, as expected, it was understood that the borate-phosphate film crystallized easily when it was heated at a low temperature of about 400° C., and was destroyed to cause sintering and agglomeration. Consequently, the specific resistance of the resulting powder magnetic cores reduced sharply.

Hence, the present inventors investigated insulation films which could improve the heat resistance by using the Zachariasen's rule, because those insulation films were amorphous glassy films. The Zachariasen's rule is a rule regarding network formers (network former ions) and network modifiers (network modifier ions) which make glass. When the network former and network modifier are extracted or selected appropriately by following the rule, the inventors believed that it would be possible to produce insulation films which are good in terms of the heat resistance.

The elements, which were thus extracted eventually in the end of trials and errors, are the first elements, comprising B, P and O (additionally Fe) which are considered elements making network formers, and the second elements which are considered elements making network modifiers. It is believed that glassy insulation films, which are made by putting network modifiers, being the second elements whose ion radius is great, in the network formers, being composed of the first elements, are less likely to crystallize and the viscosity is enhanced. Thus, the glassy insulation films are less likely to cause sintering and agglomeration. When the noble insulation films were justified for the heat resistance actually, they sustained sufficient insulation even when they were heated to elevated temperatures of 400° C. or more, for example, and further at a high temperature of 500° C. approximately.

Here, the cations of the second element are adapted to be bivalent or more, because monovalent cations, for example, $Na^+$ and $K^+$, are likely to react with water. Accordingly, taking the long-term stability of monovalent cations into consideration, it is preferred that monovalent catioins do not exist. Moreover, the ion radius, defined by Shannon, R. D., is used, because it is widely used currently. Among the ion radii, the hexa-coordinated ion radius is employed in order to make comparing objects definite, because ion radii depend on coordination numbers. Moreover, the present inventors investigated a variety of elements. As a result, it was discovered that the resulting insulation films revealed good heat resistance when the second elements had an ion radius of 0.073 nm or more. On the contrary, when the ion radius was less than 0.073 nm, the resulting insulation films exhibited heat resistance at conventional level, and accordingly no heat-resistance improvement was achieved at all. Note that it is more preferable that the ion radius can be 0.075 nm or more, further 0.080 nm or more. In addition, taking the handling property, and the like, into consideration, the upper limit of the ion radius can preferably be 0.170 nm or less.

Specifically, as for such a second element, it is possible to name alkaline-earth metal elements and rare-earth elements, the like, for example. The alkaline-earth metal elements can be beryllium (Be), Mg, Ca, Sr, barium (Ba) and radium (Ra). However, since Be and Mg have a hexa-coordinated ion radius of less than 0.073 nm, they are excluded herein. Taking the handling property, safety, environmental friendliness, and the like, into consideration, Ca or Sr can be a preferable option. Moreover, the rare-earth elements can be scandium (Sc), Y, lanthanide series elements (La through Lu) and actinide series elements (Ac through Lr). Likewise, taking the handling property, and so forth, into consideration, Y can be a more preferable option. In addition to the aforementioned elements, it is possible to name bismuth (Bi) which can be the second element. Table 1 below summarizes the ion radii of these elements together with their valance numbers for reference. Note that it is needless to say that the second element can be not only one of these elements but also a plurality of these elements.

TABLE 1

| Network Modifier Element | | Hexa-Coordinated Ion Radius (nm) |
|---|---|---|
| Alkaline-Earth Metal Element | $Mg^{2+}$ | 0.0720 |
| | $Ca^{2+}$ | 0.1000 |
| | $Sr^{2+}$ | 0.1180 |
| | $Ba^{2+}$ | 0.1350 |
| Rare-Earth Element | $Sc^{3+}$ | 0.0745 |
| | $Y^{+3}$ | 0.0900 |
| | $La^{3+}$ | 0.1032 |
| Other | $Bi^{3+}$ | 0.1030 |

By the way, the present insulation film is good in terms of the heat resistance as described above. However, it is not necessarily easy to quantitatively assess the heat resistance. For example, when the present insulation film covers a surface of a magnetic powder whose major component is Fe, it exhibits heat resistance against 450° C. or more. However, the fact does not necessarily mean that all of the present insulation film is not destroyed at all. It is important herein that, in accordance with the present invention, the resulting present insulation films are inhibited from being destroyed so that the specific resistance is not reduced sharply even in such an elevated temperature range where most of conventional insulation films are destroyed. Therefore, even when the specific resistance of powder magnetic cores is lowered more or less by annealing them so that the eddy current loss is enlarged, in the meanwhile, when the residual strain is removed to decrease the hysteresis loss so that the iron loss is reduced as a whole, ample merits exist in the present insulation film. Based on these facts, the "heat-resistant temperature," set forth in the present invention, designates a predetermined temperature at which the specific resistance of insulation films does not show sharp reduction.

Moreover, since the present insulation film exhibits a high heat-resistant temperature, it shows sufficient heat-resistant allowance when it is subjected to conventional annealing heat treatments (for example, when an annealing temperature is 400° C. or less). Accordingly, in accordance with the present insulation film, it possible to simultaneously achieve securing a large specific resistance stably and removing residual strain.

In addition, even if the present insulation film is not subjected to a heat treatment such as annealing, when it is applied to powder magnetic cores for electromagnetic appliances which are used under high-temperature environments, the resulting electromagnetic appliances become good in terms of the heat resistance, and can show stable performance up to an elevated temperature range.

As described above, the present insulation film is especially effective when it is used to cover a surface of magnetic powders which make powder magnetic cores, for example. However, its applications are not limited to such a case. For instance, the present insulation film can be used to cover a surface of plate-shaped magnetic materials such as thin silicon steel plates. Moreover, not to speak of covering magnetic materials, it can cover a surface of members which require insulative property. In particular, it is suitable to cover a surface of members, which require insulative property at an elevated temperature range, with the present insulation film.

Process for Producing Insulation Film

It is possible to produce the present insulation film which is good in terms of the heat resistance as described above by a production process according to the present invention as hereinafter described, for example. Specifically, the production process comprises the steps of: contacting a mating member to be covered with a coating treatment liquid in which a compound and/or salt, being composed of an element capable of generating cations whose hexa-coordinated ion radius, defined by Shannon, R. D., is 0.073 nm or more, and which are bivalent or more, is mixed with boric acid and phosphoric acid to make a solution; and drying the mating member after the contacting step, whereby an insulation film is formed on a surface of the mating member.

Powder for Magnetic Core

When the present insulation film covers a surface of magnetic powders, it is possible to produce powders for magnetic cores, powders which are suitable for producing powder magnetic cores. Therefore, it is possible to adapt the present invention for a powder for a magnetic core a magnetic powder comprising: a magnetic powder; and an insulation film covering a surface of the magnetic powder, wherein first elements comprising B, P and O (additionally Fe), and a second element capable of generating cations whose hexa-coordinated ion radius, defined by Shannon, R.

D., is 0.073 nm or more, and which are bivalent or more, are requisite constituent elements.

Process for Producing Magnetic Core Powder

It is possible to produce such a magnetic core powder by a production process according to the present invention as hereinafter described, for instance. Specifically, the production process comprises the steps of: contacting a magnetic powder with a coating treatment liquid in which a compound and/or salt, being composed of an element capable of generating cations whose hexa-coordinated ion radius, defined by Shannon, R. D., is 0.073 nm or more, and which are bivalent or more, is mixed with boric acid and phosphoric acid to make a solution; and drying the magnetic powder after the contacting step, whereby an insulation film is formed on a surface of the magnetic powder.

Powder Magnetic Core

Moreover, when the resulting magnetic core powder is formed by pressurizing, it is possible to produce a powder magnetic core which is good in terms of the heat resistance. Therefore, it is possible to adapt the present invention for a powder magnetic core formed by pressuring a magnetic core powder, a surface of the magnetic core powder covered with an insulation film, wherein first elements comprising B, P and O (additionally Fe), and a second element capable of generating cations whose hexa-coordinated ion radius, defined by Shannon, R. D., is 0.073 nm or more, and which are bivalent or more, are requisite constituent elements.

Process for Producing Powder Magnetic Core

Then, it is possible to produce the powder magnetic core by a production process according to the present invention as hereinafter described, for example. Specifically, the production process comprises the steps of: filling a magnetic core powder in a forming mold, a surface of the magnetic core powder covered with an insulation film, wherein first elements comprising B, P and O (additionally Fe), and a second element capable of generating cations whose hexa-coordinated ion radius, defined by Shannon, R. D., is 0.073 nm or more, and which are bivalent or more, are requisite constituent elements; and forming the magnetic core powder within the forming mold by pressurizing.

Note that the magnetic materials and magnetic powders set forth in the present specification are those in which ferromagnetic elements, such as the transition elements of group VIII (e.g., Fe, Co, Ni, etc.), are major components. Among them, in view of the handling property, availability and costs, those in which Fe is a major component are preferable options. Moreover, Fe powders with high purity (e.g., purity of 99.7% or more) are preferable options as the magnetic powders.

In accordance with the present invention, it is possible to produce an insulation film which is good in terms of the heat resistance. Moreover, a magnetic core powder which is covered with the insulation film, and a powder magnetic core which is formed by pressurizing the magnetic core powder can exhibit a large specific resistance up to an elevated temperature range.

In particular, when the powder magnetic core is annealed, the specific resistance of the powder magnetic core is not reduced sharply because the insulation film exhibits good heat resistance. Moreover, the residual strain in the powder magnetic core is removed so that the hysteresis loss is reduced.

BRIEF DESCRIPTION OF THE DRAWING

A more complete appreciation of the present invention and many of its advantages will be readily obtained as the same becomes better understood by reference to the following detailed description when considered in connection with the accompanying drawing and detailed specification, all of which forms a part of the disclosure.

DETAILED DESCRIPTION OF THE PREFERRED EMBODIMENTS

Figure 1:
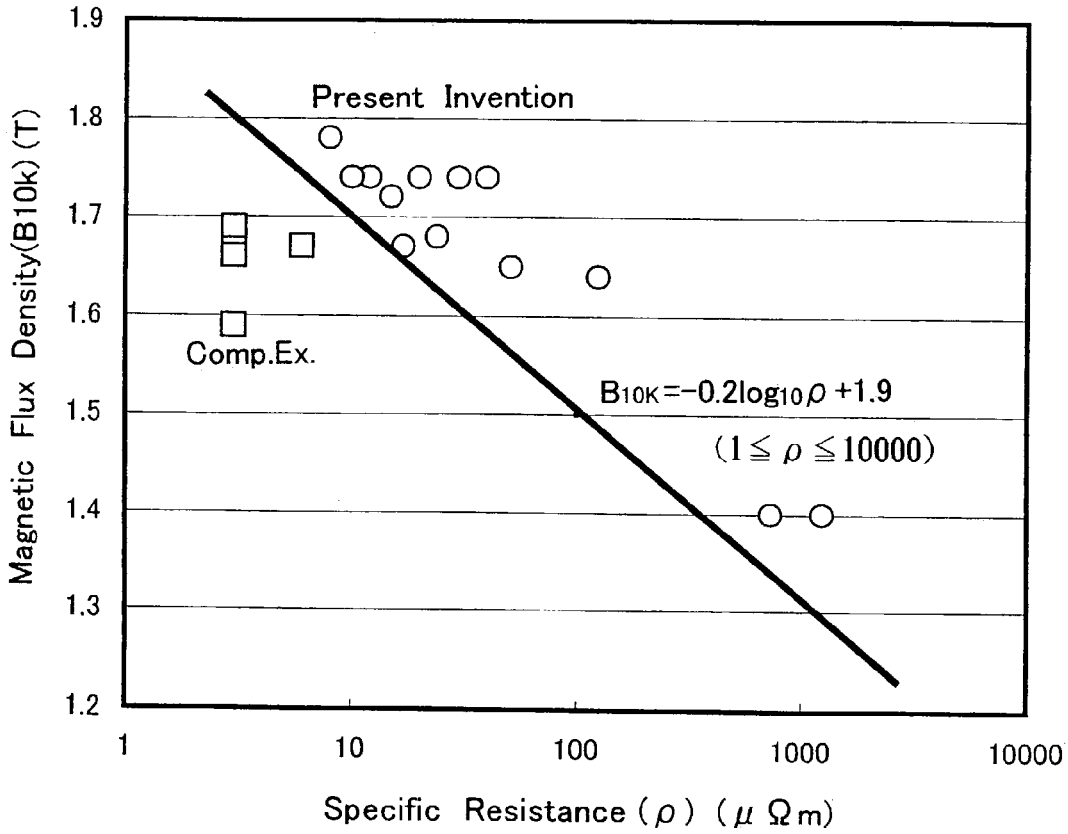
FIG. 1 is a graph for illustrating the relationship between the specific resistances ρ (μΩm) and magnetic flux densities $B_{10k}$ (T) which were measured with regard to test pieces of examples according to the present invention.

Having generally described the present invention, a further understanding can be obtained by reference to the specific preferred embodiments which are provided herein for the purpose of illustration only and not intended to limit the scope of the appended claims.

Hereinafter, the present invention will be described more specifically while naming preferred embodiments. Note that it should be reminded that, in addition to the following preferred embodiments, the contents described in the present specification are properly applicable not only to the insulation film according to the present invention but also to magnetic core powders, powder magnetic cores and production processes for the same.

(1) Insulation Film

As described above, in the present insulation film, the first elements, such as B, P and O (additionally Fe), and the second element, such as Ca whose ion radius is large, are requisite constituent elements. The B, P and O are network former elements, and Ca, and the like, are network modifier elements. It is believed that these elements form glassy insulation films.

Of course, the elements are requisite constituent elements of the present insulation film, and the present insulation film can contain the other elements. In particular, depending on production processes, it is fully possible to believe that the present insulation film includes the elements (e.g., Fe, etc.) of mating members to be covered therewith.

Here, it is necessary to consider the reactivity between the mating members (e.g., magnetic powders) and the present insulation film. Namely, when insulation films are likely to react with mating members, insulation films are likely to be destroyed (or broken). Hence, it is preferable to select the second element of the present insulation film while taking the quality of materials to be covered into consideration. For example, when Fe is a major component in the mating members to be covered, the second element can preferably be an element whose standard formation energy of oxide is negatively larger than that of $P_2O_5$. In short, the elements whose standard formation energy of oxide is negatively larger than that of $P_2O_5$ are elements which are more likely to be oxidized than $P_2O_5$.

Note that Fe's standard formation energy of oxide is at the same level as that of $P_2O_5$. Accordingly, compared with conventional phosphate films, insulation films, which include the second elements whose standard formation energy of oxide is negatively larger than that of $P_2O_5$, are less likely to react with mating members (e.g., magnetic powders, etc.) in which Fe is a major component, and are more stable at high temperatures. To put it the other way around, if the second elements' standard formation energy of oxide is negatively smaller than that of $P_2O_5$, it is not preferred because the heat resistance of the resulting insulation films is less than that of conventional phosphate films.

The thicker the thickness is, the larger insulation films exhibit resistance. However, when magnetic powders for powder magnetic cores are covered with insulation films, if the thickness is too thick, the magnetic flux density of the formed powder magnetic cores lowers. Accordingly, from the viewpoint of securing the magnetic flux density and specific resistance of powder magnetic cores, the present insulation film can preferably have a thickness falling in a range of from 10 to 100 nm, further preferably from 10 to 50 nm.

(2) Powder for Magnetic Core

The present magnetic core powder is a magnetic powder whose surface is covered with the present insulation film, and is mainly used for producing magnetic cores. As the magnetic powder which is a raw material powder for the present magnetic core powder, it is possible to think of powders in which ferromagnetic elements are a major component. However, in view of the costs and availability, Fe powders are a general option. In particular, a pure iron powder whose purity is 99.5% or more, further 99.8% or more, is a suitable option. As such an iron powder, it is possible to use "ABC100.30" made by Höganäs AB., for example. In the iron powder, components other than Fe are controlled so that C is included in an amount of 0.001% by mass, Mn is included in an amount of 0.02% by mass and O is included in an amount of 0.08% by mass. Thus, compared with the other commercially available iron powders, the content of impurities is extremely less. Moreover, since the pure iron powder is good in terms of the compressibility, it is suitable for producing powder magnetic cores.

In addition to pure iron, the magnetic powder can further contain ferromagnetic elements such as cobalt (Co) and nickel (Ni). For example, when Co is included in an amount of from 5 to 30% by mass with respect to the entire magnetic powder taken as 100% by mass, it is preferable because it is possible to improve the magnetic flux density of the resulting powder magnetic cores. In addition to Co and Ni, Si or Al can be included in an amount of from 0.3 to 4% by mass approximately with respect to the entire magnetic powder taken as 100% by mass. Of course, it is preferable to decrease the content of impure elements, which lower the magnetic characteristics of the magnetic powder, as much as possible.

Moreover, the magnetic powder can be mixture powders in which a plurality of powders are mixed. For example, it can be mixture powders such as a mixture powder of a pure iron powder and an Fe-49Co-2V powder and a mixture powder of an Fe-9Si-6Al powder and a pure iron powder.

In order to highly compact powder magnetic cores, it is suitable that the particle diameters of the magnetic core powder can fall in a range of from 20 to 300 μm, further from 50 to 200 μm. According to tests carried out by the present inventors, from the viewpoint of reducing the eddy current loss, it is preferred that the particle diameters can be finer, for example, can be controlled to 50 μm or less. On the other hand, from the viewpoint of reducing the hysteresis loss, it is preferred that the particle diameters can be coarser, for instance, can be controlled to 100 μm or more. Note that it is possible to classify the magnetic powder by a sieve classification method, and the like, with ease.

(3) Powder Magnetic Core

The present powder magnetic core is formed by pressurizing the above-described magnetic powder. As far as the constituent particles of the present powder magnetic core are covered with the present insulation film, its magnetic characteristics, and so forth, do not matter at all. Indeed, since the constituent particles are covered with the present insulation film, the present powder magnetic core can secure the electric characteristics (e.g., specific resistance) up to an elevated temperature range. Moreover, when a later-described warm high-pressure forming method is employed, it is possible to produce the present powder magnetic core which is remarkably good even in terms of the magnetic characteristics.

Hereinafter, the electric characteristics, magnetic characteristics and mechanical characteristics of the present powder magnetic core will be described. One of the representative characteristics which index the electric characteristics of powder magnetic cores is the specific resistance. The specific resistance does not depend on the configurations of powder magnetic cores, and is an intrinsic value for every powder magnetic core. When powder magnetic cores have an identical configuration, the larger the specific resistance is the less the eddy current loss is.

In the present powder magnetic core, not only the specific resistance is stable up to an elevated temperature range, but also the actual value is large. For example, when the present powder magnetic core is not subjected to annealing after it is formed, the specific resistance is 30 μΩm or more, further such a high value as 1,000 μΩm or more. Even in the case where it is subjected to annealing, when the annealing temperature is about 400° C., the specific resistance is 10 μΩm or more, further such a high value as 20 μΩm or more. Moreover, even when the annealing temperature is from 450 to 500° C. approximately, it is possible for the present powder magnetic core to securely exhibit the specific resistance of 5 μΩm or more, further 10 μΩm or more.

The representative characteristic which indexes the magnetic characteristics of powder magnetic cores might originally be the magnetic permeability. However, it is understood from general B-H curves that the magnetic permeability is not constant. Hence, as a substitute therefor, the magnetic characteristics of powder magnetic cores will be hereinafter specified by the magnetic flux density which is produced when magnetic cores are put in a magnetic field with a predetermined strength.

As examples of the specific magnetic field, a low magnetic field (e.g., 2 kA/m) and a high magnetic filed (e.g., 10 kA/m) are selected. In accordance with the magnetic flux densities $B_{2k}$ and $B_{10k}$ which are produced when the present powder magnetic core is put in the magnetic fields, the magnetic characteristic of the present powder magnetic core was assessed. According to the present powder magnetic core, it is possible to produce a sufficiently large magnetic flux density such as $B_{2k} \geqq 1.1T$, further 1.2T, furthermore 1.3T in the 2 kA/m low magnetic field. Moreover, it is possible to produce a sufficiently large magnetic flux density such as $B_{10k} \geqq 1.6T$, further 1.7T in the 10 kA/m high magnetic field.

Note that magnetic cores do not produce a large magnetic flux density when the saturation magnetization Ms is small. However, the present powder magnetic core exhibits such a saturation magnetization Ms as $Ms \geqq 1.9T$, further 1.95T or more, in a 1.6 MA/m magnetic field. Thus, it can produce a high magnetic flux density even in a high magnetic field.

Moreover, the coercive force which indexes the magnetic characteristics of powder magnetic cores. In powder magnetic cores, the smaller the coercive force is with respect to alternating magnetic fields, the better the follow-up property is, and the hysteresis loss diminishes. As described above, it is possible to reduce the coercive force by removing residual strain. When annealing is carried out at high temperatures by utilizing the good heat resistance of the present insulation film, the coercive force bHc can be 320 A/m or less, further 300 A/m or less, furthermore such a low value as 290 A/m or less. In the present specification, note that the coercive force bHc is defined by a value which is obtained from a magnetization curve produced in a magnetic filed whose maximum strength is 2 kA/m.

One of the representative characteristics which index the mechanical characteristics of powder magnetic cores is the strength. Contrary to cast products or sintered products, powder magnetic cores are mainly bound mechanically by the plastic deformation of constituent particles covered with insulation films. Accordingly, the strength is poor originally. However, by a later-described warm high-pressure forming method, the present powder magnetic core is strong enough to expand its applications.

In particular, even when the magnetic powder covered with the present insulation film comprises a spheroidal gas atomized powder, since the present insulation films are entangled with each other and exert attraction forces, and the like, the actions bind the respective constituent particles of the powder magnetic core firmly. Accordingly, it is possible to produce green compacts (or powder magnetic cores) which are good in terms of the strength as well. For example, the present powder magnetic core can exhibit such a high strength that a 4-point bending strength $\sigma$ is 50 MPa or more, further 100 MPa or more. Note that the 4-point bending strength $\sigma$ is not prescribed in JIS (i.e., Japanese Industrial Standard), but can be determined by the testing methods of green compacts.

(4) Process for Producing Insulation Film or Process for Producing Magnetic Core Powder The present process for producing an insulation film as well as the present process for producing a magnetic core powder comprise basically the contacting step of contacting a mating member (or magnetic powder) with a coating treatment liquid, and the following drying step. Note that the mating member of the present insulation film is not limited to magnetic powders, but the case where the mating member is a magnetic powder is hereinafter exemplified whenever it is proper.

The coating treatment liquid is aqueous solutions which include boric acid, phosphoric acid and the second element designated specifically in the present invention. Note that it is not limited to aqueous solutions, but can be solutions which use organic solvents such as ethanol, methanol, isopropyl alcohol, acetone, glycerol. Anyway, the coating treatment liquid is made by mixing phosphoric acid and boric acid in the solvents and solving the compounds or salts of alkaline-earth elements or rare-earth elements therein.

Moreover, surfactants and rust prevention agents can be added to the coating treatment liquid. The surfactants improve the wettability of the coating treatment liquid with respect to magnetic powders (e.g., Fe powders), and improve the later-described contacting step so as to form uniform films. The rust prevention agents inhibit magnetic powders (e.g., Fe powders) from being oxidized.

The contacting step can be carried out by a variety of methods (or processes) such as a solution spraying method (or spraying process), and a solution immersion method (immersing process). In the solution spraying method, the coating treatment liquid is sprayed onto the mating member. In the solution immersion method, the mating member is immersed into the coating treatment liquid. The solution spraying method and the solution immersion method make it possible to process in a large volume, and accordingly are effective methods industrially.

Moreover, the contacting step is not limited to those methods. Uniform films can be formed thinly on a surface of the mating member by utilizing electrochemical reactions such as plating. If such is the case, since the surface of the mating member covered with the insulation films are insulated electrically, the not-covered superficial portion (or exposed portion) is naturally reacted with the coating treatment liquid preferentially. As a result, the surface of the mating member (or magnetic powder) is coated successively, and accordingly the entire surface of the mating member is covered with the present insulation film uniformly and free from pinholes.

Moreover, by varying the concentration of the coating treatment liquid used in the contacting step, it is possible to control the thickness of the formed insulation films. When the concentration of the coating treatment liquid is concentrated, the insulation films with a thick thickness are produced. When it is diluted, the insulation films with a thin thickness are produced. Of course, the insulation films with a thin thickness can be formed in a laminated manner to make the insulation films with a heavy thickness as a whole.

In addition, it is believed that the time for contacting the mating member with the coating treatment liquid affects the thickness of the resulting insulation films. However, since the time for reacting them is short actually, even if the contacting time is prolonged, the thickness varies less when the surface of the mating member is once covered with the coating treatment liquid.

In the drying step, the excessive coating treatment liquid adhered to the mating member and the solvent are given off. The drying step can be carried out by drying with heat, or can even be carried out by drying naturally. Indeed, in order to stably and quickly fix the present insulation film on a surface of the mating member, drying with heat (i.e., a heating-drying step) is a preferable option. The heating temperature can preferably fall in a range of from 200 to 350° C. approximately. The heating time can preferably fall in a range of from 10 to 60 minutes approximately. Note that regarding the heating atmosphere, the drying step can be carried out in degassed vacuum or in nitrogen, but it is suffice to carry out the drying step in air.

(5) Process for Producing Powder Magnetic Core

The present process for producing a powder magnetic core comprises basically the filling step of filling the above-described magnetic core powder in a forming mold, and the forming step of forming the filled magnetic core powder by pressurizing. In order to improve the magnetic characteristics of the resulting powder magnetic cores, the important step is the forming step. In particular, from the viewpoint of highly densifying the powder magnetic cores and making them produce high magnetic flux density, and the like, accompanying therewith, the forming pressure is very important.

Indeed, when the forming pressure is enlarged, it is likely to cause galling and/or scoring between an inner surface of the forming mold and the magnetic core powder, to sharply enlarge the pressure for ejecting the resulting powder magnetic cores, and to remarkably shorten the longevity of the forming mold. Accordingly, in conventional forming methods, it is difficult to actually enlarge the forming pressure.

However, as described above, the present inventors established a revolutionary hot high-pressure forming method, and solved the problem. In the warm high-pressure forming method, the filling step is adapted so that a magnetic core powder is filled in a forming mold in which a higher fatty acid-based lubricant is applied to an inner surface thereof, and the forming step is adapted to be such a high-pressure forming step that a metallic soap film is generated between the magnetic core powder and the inner surface of the forming mold.

Naming an example, when a powder in which Fe is a major component is used as the magnetic powder and lithium stearate is used as the higher fatty acid-based lubricant, a metallic soap film is formed on an outer surface of the resulting powder magnetic cores which contacts with the inner surface of the forming mold. The metallic soap film comprises iron stearate which is good in terms of the lubricating property. Due to the presence of the iron stearate film, galling and/or scoring, and the like, do not take place. Moreover, the resulting powder magnetic cores can be removed from the forming mold with a very low ejection force. In addition, the longevity of the forming mold is little shortened.

Hereinafter, the innovative production process will be described in more detail.

(a) Filling Step

When carrying out the filling step, it is necessary to apply a higher fatty acid-based lubricant to an inner surface of the forming mold (i.e., a coating step). In addition to higher fatty acids themselves, it is suitable that the higher fatty acid-based lubricant to be applied can be metallic salts of higher fatty acids. The metallic salts of higher fatty acids can be lithium salts, calcium salts, zinc salts, and the like. In particular, lithium stearate, calcium stearate and zinc stearate can be preferable options. In addition, it is also possible to use barium stearate, lithium palmitate, lithium oleate, calcium pamitate, calcium oleate, and so forth.

It is suitable to adapt the coating step so that the higher fatty acid-based lubricant, which is dispersed in water or an aqueous solution, is sprayed into the forming mold, which is heated. When the higher fatty acid-based lubricant is dispersed in water, or the like, it is possible to uniformly spray the higher fatty acid-based lubricant onto the inner surface of the forming mold. Moreover, when it is sprayed into the heated forming mold, the water content evaporates quickly so that it is possible to uniformly adhere the higher fatty acid-based lubricant on the inner surface of the forming mold. In this instance, although it is necessary to take the temperature in the forming step described later into consideration, it is sufficient to heat the forming mold to a temperature of 100° C. or more, for example. In actuality, however, it is preferable to control the heating temperature to less than the melting point of the higher fatty acid-based lubricant in order to form a uniform higher fatty acid-based lubricant film. For instance, when lithium stearate is used as the higher fatty acid-based lubricant, the heating temperature can preferably be controlled to less than 200° C.

Further, when the higher fatty acid-based lubricant is dispersed in water, or the like, note that it is preferred that the higher fatty acid-based lubricant can be included in an amount of from 0.1 to 5% by mass, further from 0.5 to 2% by mass, with respect to the entire mass of the resulting aqueous solution taken as 100% by mass. Thus, a uniform lubricant film can be formed on the inner surface of the forming mold.

Furthermore, in dispersing the higher fatty acid-based lubricant in water, or the like, it is possible to uniformly disperse the higher fatty acid-based lubricant when a surfactant is added to water, or the like, in advance. As such a surfactant, it is possible to use 6-grade polyoxyethylene nonyl phenyl ether (EO), 10-grade polyoxyethylene nonyl phenol ether (EO), anionic surfactants, cationic surfactants, amphoteric surfactants, nonionic surfactants, boric acid ester-based emulbon "T-80" (trade name), and the like, for example. It is possible to combine two or more of the surfactants to use. For instance, when lithium stearate is used as the higher fatty acid-based lubricant, it is preferable to use three kinds of surfactants, 6-grade polyoxyethylene nonyl phenyl ether (EO), 10-grade polyoxyethylene nonyl phenyl ether (EO) and boric acid ester emulbon "T-80" (trade name), at the same time. This is because, when the surfactants are added combinedly to the higher fatty acid-based lubricant aqueous solution, the dispersibility of lithium stearate to water, or the like, is furthermore activated, compared with the case where one and only surfactant is added to water, or the like.

Moreover, in order to prepare the higher fatty acid-based lubricant aqueous solution which exhibits a viscosity applicable to spraying, the proportion of the surfactant can preferably be controlled in a range of from 1.5 to 15% by volume with respect to the entire mass of the resulting aqueous solution taken as 100% by volume.

In addition to the surfactant, it is preferable to further add an antifoaming agent in a small amount. This is because, when the aqueous solution, which bubbles vigorously, is sprayed, it is less likely to uniformly form a higher fatty acid-based lubricant film on the inner surface of the forming mold. The antifoaming agent can be silicone-based antifoaming agents, for example. The addition proportion of the antifoaming agent can preferably fall in a range of from 0.1 to 1% by volume approximately with respect to the entire volume of the aqueous solution taken as 100% by volume, for instance.

It is suitable that the particles of the fatty acid-based lubricant, which is dispersed in water, or the like, can preferably have a maximum particle diameter of less than 30 μm. When the maximum particle diameter is 30 μm or more, the particles of the higher fatty acid-based lubricant are likely to precipitate in the resulting aqueous solution so that it is difficult to uniformly apply the higher fatty acid-based lubricant on the inner surface of the forming mold.

It is possible to carry out applying the aqueous solution, in which the higher fatty acid-based lubricant is dispersed, by using spraying guns for coating operations, electrostatic guns, and the like. Note that the inventors of the present invention examined the relationship between the applying amounts of the higher fatty acid-based lubricant and the pressures required for ejecting green compacts. According to the results, it has been understood that it is preferable to apply the higher fatty acid-based lubricant in such a thickness of from 0.5 to 1.5 μm approximately on the inner surface of the forming mold.

(b) Forming Step

Although the details have not been cleared yet, it is believed that the above-described metallic soap film is generated by mechanochemical reactions. Specifically, due to the reactions, the present magnetic core powder (especially, the present insulation film) and the higher fatty acid-based lubricant are bonded chemically. A metallic soap film, for example, an iron salt film of a higher fatty acid, is formed on a surface of a green compact of the present magnetic core powder. The resulting metallic soap film is firmly bonded to the surface of the green compact, and effects better lubricating performance than the higher fatty acid-based lubricant does which has been adhered to the inner surface of the forming mold. As a result, the frictional force is reduced sharply between the inner surface of the forming mold and the outer surface of the green compact. Accordingly, it is believed that it is possible to carry out forming with high pressures.

Although the respective particles of the present powder for a magnetic core are covered with the present insulation film, elements, which facilitate the formation of the metallic soap film, are included as major components in the present insulation film. Accordingly, it is believed that the metallic soap film (or the film made of the higher-fatty-acid metallic salts) is formed based on the elements. Such metallic-soap-film formation facilitating elements are Fe, a major component of magnetic powders, and the elements designated as the second element in the present invention, for example.

In the forming step, the term, "warm," implies that the forming step is carried out under properly heated conditions according to specific conditions. Indeed, it is preferable in general to control the forming temperature to 100° C. or more in order to facilitate the reaction between the present magnetic core powder and the higher fatty acid-based lubricant. Moreover, it is preferable in general to control the forming temperature to 200° C. or less in order to inhibit the present insulation film from being destroyed and inhibit the higher fatty acid-based lubricant from being degraded. In addition, it is more suitable to control the forming temperature in a range of from 120 to 180° C.

The extent of "pressurizing" in the forming step is determined according to the characteristics of desired powder magnetic cores, the types of magnetic core powders, insulation films and higher fatty acid-based lubricants, the material qualities and inner surface properties of the forming mold, and the like. However, when the revolutionary production process is used, it is possible to carry out forming under high pressures which are beyond conventional forming pressures. Accordingly, it is possible to control the forming pressure to 700 MPa or more, further 785 MPa or more, furthermore 1,000 MPa or more, moreover 2,000 MPa or more, for example. The higher the forming pressure is, it is possible to produce a powder magnetic core with a higher density. Indeed, taking the longevity of forming mold and the productivity into consideration, it is desirable to control the forming pressure to 2,000 MPa or less, more desirably to 1,500 MPa or less.

Note that, in the case where the innovative warm high-pressure forming method is used, the present inventors have confirmed by experiments that the ejecting pressure reaches the maximum when the forming pressure is about 600 MPa, and that the ejecting pressure lowers instead when the forming pressure is 600 MPa or more. Even when the forming pressure was varied in a range of from 900 to 2,000 MPa, the ejecting pressure was maintained at such a very low value as 5 MPa approximately. From these facts, it is understood how the metallic soap film, which is formed by the revolutionary warm high-pressure forming method, one of the production processes according to the present invention, is good in terms of the lubricating property. Thus, it is seen that the warm high-pressure forming method is optimum as a production process for powder magnetic cores which require high densification by forming with high pressures. Not limited to the case where lithium stearate is used as the higher fatty acid-based lubricant, such phenomena can occur similarly even when calcium stearate and zinc stearate are used as the higher fatty acid-based lubricant.

(c) Annealing Step

The annealing step is carried out in order to remove residual stress and strain from green compacts. Accordingly, the coercive force of the present powder magnetic core is reduced, the hysteresis loss is reduced, and the follow-up property with respect to alternating magnetic fields improves at the same time. Consequently, the magnetic characteristics of the present powder magnetic core are upgraded. The heating temperature in this instance depends on the material qualities of magnetic powders, however, it can preferably fall in a range of from 300 to 600° C., further preferably from 300 to 600° C., when Fe is a major component of magnetic powders. Moreover, the heating time can preferably fall in a range of from 1 to 300 minutes, further preferably from 5 to 60 minutes. When the heating temperature is less than 300° C., the advantage of reducing residual stress and strain is effected less. When it exceeds 600° C., insulation films are likely to be destroyed. Moreover, when the heating time is less than 1 minute, the advantage of reducing residual stress and strain is effected less. When green compacts are heated for beyond 300 minutes, the advantage is not upgraded all the more.

In the present powder magnetic core, since the constituent particles are covered with the present insulation film whose heat resistance is good, it is possible to more securely remove the residual strain by heightening the annealing temperature than conventional practices, for example, from 400 to 500° C. For instance, when green compacts are made from magnetic core powders whose major component is Fe, the annealing step can be carried out so that the green compacts are cooled gradually after they are heated to 400° C. or more. Of course, when the annealing step is carried out at a temperature at the same level as conventional annealing temperatures, for example, from 300 to 400° C., the specific resistance of the present magnetic core is lowered only by lesser extent because the present insulation film affords great resistance allowance.

Applications of Powder Magnet Core

The present powder magnetic core can be applied to a variety of electromagnetic appliances, such as motors, actuators, transformers, induction heaters (IH) and speakers. Since the specific resistance as well as the magnetic permeability can be enlarged in the present powder magnetic core, it is possible to highly enhance the performance of the various appliances, downsize them, make them energy-efficient, and the like, while suppressing the energy loss. For example, when the present powder magnetic core is incorporated into fuel injection valves of automotive engines, and so forth, it is possible to realize downsizing them, making them high power and simultaneously making them high response because not only the present powder magnetic core is good in terms of the magnetic characteristics but also its iron loss is less.

Moreover, the present powder magnetic core is not only good in terms of the magnetic characteristics but also in terms of the heat resistance. Accordingly, it is further preferred when the present powder magnetic core is used in products which are used under high-temperature environments. As an example, it is possible to name electromagnetic actuators used for driving engine valves. Such an electromagnetic actuator is set forth in Japanese Unexamined Patent Publication (KOKAI) No. 2001-118,725, and so on. In addition, when the present powder magnetic core is used in motors such as DC machines, induction machines and synchronous machines, it is suitable because it is possible to satisfy both downsizing and making motors high power.

EXAMPLES

The present invention will be hereinafter described in more detail with reference to examples.

(1) Production of Insulation Film and Magnetic Core Powder

As a raw material powder, a commercially available Fe powder was prepared which was produced by Höganäs AB., had a trade name "ABC100.30," and included Fe in an amount of 99.8% by mass. Here, the raw material powder was not classified, and was used as it was supplied. Accordingly, the particle diameters fell in a range of about 20 to 180 μm.

An insulation film is coated on the raw material powder in the following manner. First, an oxide of an alkaline-earth element (i.e., a compound of an alkaline-earth element) or a nitrate of a rare-earth element (i.e., a salt of a rare-earth element), both being a commercially available reagent, boric acid ($H_3BO_3$) and phosphoric acid ($H_3PO_4$) were charged into ion-exchanged water, and were stirred to dissolve therein. Then, a plurality of coating stock liquids were prepared by changing the types of the using alkaline-earth element oxide or rare-earth element nitrate, or by varying the mixing proportion thereof with respect to the boric acid ($H_3BO_3$) and phosphoric acid ($H_3PO_4$). Table 2 below summarizes the compositions of the prepared coating stock liquids. Note that the coating stock liquids were used as they were, or were diluted properly with the ion-exchanged water to use them as coating liquids (i.e., coating treatment liquids).

TABLE 2

| Coating Stock Liquid No. | | Ion-Exchanged Water (mL) | Boric Acid ($H_3BO_3$) (g) | Phosphoric Acid ($H_3PO_4$) (g) | Compound or Salt |
|---|---|---|---|---|---|
| Ex. | 1 | 200 | 3 | 32 | CaO: 4.3 g |
| | 2 | 200 | 3 | 16 | SrO: 8 g |
| | 3 | 200 | 3 | 32 | SrO: 8 g |
| | 4 | 200 | 0.4 | 1.2 | $Y(NO_3)_3.6H_2O$: 1 g |
| | 5 | 200 | 0.4 | 1.2 | $Y(NO_3)_3.6H_2O$: 0.5 g |
| Comp. | C1 | 200 | None | 16 | None |
| Ex. | C2 | 200 | 3 | 16 | None |
| | C3 | 200 | 9 | 16 | None |
| | C4 | 200 | 3 | 32 | None |
| | C5 | 200 | 6 | 33 | MgO: 6.2 g |

Next, the various coating liquids were dropped in an amount of 20 mL over the Fe powder, being a magnetic powder, which was put in a 100 mL beaker in an amount of 100 g (i.e., a contacting step). After leaving the mixtures for 5 minutes, the Fe powder was taken out of the beakers, and was dried with an electric furnace at 300° C. for 30 minutes in air (i.e., a drying step). Thus, insulation films were fixed on a surface of the Fe powder to produce magnetic core powders which were used as raw material powders for powder magnetic cores.

(2) Production of Powder Magnetic Core

With respect to the thus produced various magnetic core powders for every samples, two types of test pieces, ring-shaped test pieces and plate-shaped test pieces, were produced by carrying out a warm high-pressure forming method with a lubricated mold. The ring-shaped test pieces were ϕ39 mm outside diameter, ϕ30 mm inside diameter and 5 mm thick. The plate-shaped test pieces were 5 mm thick, 10 mm wide and 55 mm long. The ring-shaped test pieces were for assessing the magnetic characteristics. The plate-shaped test pieces were for assessing the electric resistance. Note that no internal lubricants, resinous binders, and the like, were not mixed at all with the magnetic core powders in forming the test pieces (or magnetic cores).

The warm high-pressure forming was carried out specifically in the following manner. Forming molds were prepared which had cavities conforming to the shapes of the aforementioned test pieces and were made from cemented carbide. The forming molds were heated to 150° C. with a band heater in advance. Note that an inner peripheral surface of the forming molds were subjected to a TiN coating treatment in advance, and its superficial roughness was controlled to 0.4Z.

Then, onto the inner peripheral surface of the heated forming molds, lithium stearate, which was dispersed in an aqueous solution, was applied uniformly with a spraying gun at a rate of 1 $cm^3$/sec. approximately (i.e., an applying step). The aqueous solution used herein was made by adding a surfactant and an antifoaming agent to water. As the surfactant, 6-grade polyoxyethylene nonyl phenyl ether (EO), 10-grade polyoxyethylene nonyl phenyl ether (EO) and boric acid ester-based emulbon "T-80" (trade name) were used, and each of them was added in an amount of 1% by volume each with respect to the entire aqueous solution taken as 100% by volume. Moreover, as the antifoaming agent, "FS antifoam 80" (trade name) was used, and was added in an amount of 0.2% by volume with respect to the entire aqueous solution taken as 100% by volume.

Moreover, the used lithium stearate exhibited a melting point of about 225° C., and had an average particle diameter of 20 μm. It was dispersed in an amount of 25 g with respect to 100 $cm^3$ of the aforementioned aqueous solution. Then, the lithium stearate was further subjected to a finely-pulverizing treatment by using a ball-mill type pulverizer provided with steel balls covered with "Telflon" (trade name) for 100 hours. The resulting stock liquid was diluted by 20 times to prepare an aqueous solution whose final concentration was 1% by mass. The thus prepared aqueous solution was used in the above-described applying step.

The aforementioned various magnetic core powders were filled in the forming molds whose inner surface was covered with the lithium stearate (i.e., a filling step). Note that the magnetic core powders were heated to 150° C. in advance as high as the forming molds were heated.

While holding the temperature of the forming molds at 150° C., the filled various magnetic core powders were warm formed with a forming pressure of 1,176 MPa (i.e., a forming step). Note that, in the warm high-pressure forming, none of the magnetic core powders cause galling, and the like, between them and the forming molds, and the resultant green compacts could be taken out of the molds with an ejecting pressure as low as 5 MPa approximately.

The thus produced green compacts were properly subjected to annealing under such condition that the annealing temperature was 400° C. or 500° C., the annealing time was 30 minutes, and the atmosphere was air.

COMPARATIVE EXAMPLES

Comparative examples were also produced in the same manner as Examples. First, a magnetic powder was covered with insulation films to produce magnetic core powders. Then, the magnetic core powders were used to produce powder magnetic cores. The comparative examples differed from the examples regarding the compositions of coating liquids which were used to coat the surface of the magnetic powder. Table 2 summarizes the compositions of the coating liquids used in comparative examples together with those used in examples.

Assessment on Insulation Film

First, the aforementioned plate-shaped test pieces were used to assess the heat resistance of the insulation films. The assessment method was as follows. Three kinds of the test pieces, the test pieces as formed (i.e., test pieces before annealing), the test pieces annealed at 400° C. and the test pieces annealed at 500° C., were prepared respectively, and were subjected to a volumetric specific resistance measurement. Note that the volumetric specific resistance measurement was carried out with a micro-ohmmeter, which was made by Hewlett-Packard Co., Ltd. and had a model number "34420A," by means of a four-probe method. Table 3 sets forth the measurement results.

In all of the test pieces, the specific resistance lowered sharply before and after the annealing. However, in the examples, both of the test pieces annealed at 400° C. and the test pieces annealed at 500° C. showed that the lowering of the specific resistances (or reduction rate) was remarkably less compared with those shown by the comparative examples. Moreover, in the comparative examples, even the test pieces annealed at 400° C. already showed sharply reduced specific resistances. On the other hand, in the examples, it is understood that not only the test pieces annealed at 400° C. but also the test pieces annealed at 500° C. maintained sufficiently high specific resistances. Thus, it was verified that the insulation films according to the present invention were good in terms of the heat resistance.

Assessment on Powder Magnetic Core

Next, a variety of the above-described ring-shaped test pieces and plate-shaped test pieces were prepared, and their magnetic characteristics and electric characteristics were assessed. Also in this assessment, the test pieces were prepared with or without annealing and the annealing temperature was varied in order to carry out diverse measurements. Here, in addition to the above-described specific resistance, the test pieces were measured for the various magnetic characteristics and density. Tables 4 and 5 recite the measurement results.

TABLE 3

| | | Coating Liquid | | Electric Characteristic of Green Compact | | | | |
|---|---|---|---|---|---|---|---|---|
| | | | | Before Annealing | Annealing at 400° C. | | Annealing at 500° C. | |
| Test Piece No. | | Composition of Stock Liquid (Stock Liquid No.) | Dilution Ratio | Specific Resistance (μΩm) | Specific Resistance (μΩm) | Reduction Rate of Specific Resistance (%) | Specific Resistance (μΩm) | Reduction Rate of Specific Resistance (%) |
| Ex. | 1 | Ca—B—P—O (Stock Liquid No. 1) | 20 Times | 60 | 15 | 75 | — | — |
| | 2 | Sr—B—P—O (Stock Liquid | Stock Liquid Itself | 3000 | 1240 | 59 | 728 | 76 |
| | 3 | No. 2) | 5 Times | 360 | 124 | 66 | 51 | 86 |
| | 4 | | 10 Times | 80 | 30 | 63 | 20 | 75 |
| | 5 | | 20 Times | 40 | 12 | 70 | 8 | 80 |
| | 6 | Sr—B—P—O (Stock Liquid No. 3) | 20 Times | 40 | 10 | 75 | — | — |
| | 7 | Y—B—P—O (Stock Liquid No. 4) | Stock Liquid Itself | 50 | 17 | 66 | — | — |
| | 8 | Y—B—P—O (Stock Liquid No. 5) | Stock Liquid Itself | 95 | 24 | 75 | — | — |
| Comp. Ex. | C1 | P—O (Stock Liquid No. C1) | 20 Times | 30 | 6 | 80 | 2 | 93 |
| | C2 | B—P—O (Stock Liquid No. C2) | 20 Times | 30 | 3 | 90 | — | — |
| | C3 | B—P—O (Stock Liquid No. C3) | 20 Times | 30 | 3 | 90 | — | — |
| | C4 | B—P—O (Stock Liquid No. C4) | 20 Times | 30 | 3 | 90 | — | — |
| | C5 | Mg—B—P—O (Stock Liquid | Stock Liquid Itself | 1000 | 200 | 80 | — | — |
| | | No. C5) | 20 Times | 30 | 6 | 80 | 3 | 90 |

TABLE 4

| Test Piece No. | Coating Liquid: Composition of Stock Liquid (Stock Liquid No.) | Coating Liquid: Dilution Ratio | Annealing Temp. (° C.) (In Air, Heating for 30 min.) | Static Magnetic Field Characteristic (T): $B_{1k}$ | $B_{2k}$ | $B_{5k}$ | $B_{8k}$ | $B_{10k}$ | Max. Magnetic Permeability (μm) | Coercive Force (A/m) | Alternating Magnetic Field Characteristic (1.0 T/800 Hz) (kW/m³): Total Loss Pc | Hysteresis Loss Ph | Eddy Current Loss Pe | Specific Resistance (ρΩm) | Density (×10³ kg/m³) |
|---|---|---|---|---|---|---|---|---|---|---|---|---|---|---|---|
| Ex. 9 | Ca—B—P—O (Stock Liquid No. 1) | 20 Time | 400 | 0.82 | 1.20 | 1.52 | 1.66 | 1.72 | 690 | 320 | 1160 | 800 | 380 | 15 | 7.71 |
| 10 | Sr—B—P—O (Stock Liquid No. 2) | Stock Liquid Itself | 400 | 0.32 | 0.64 | 1.09 | 1.31 | 1.40 | 270 | 300 | 970 | 890 | 80 | 1240 | 7.47 |
| 11 | | | 500 | 0.36 | 0.67 | 1.12 | 1.32 | 1.40 | 280 | 280 | 920 | 740 | 180 | 728 | 7.45 |
| 12 | | 5 Times | 400 | 0.60 | 1.02 | 1.42 | 1.56 | 1.64 | 490 | 310 | 930 | 780 | 150 | 124 | 7.61 |
| 13 | | | 500 | 0.66 | 1.07 | 1.44 | 1.59 | 1.65 | 530 | 280 | 940 | 680 | 260 | 51 | 7.63 |
| 14 | | 10 Times | 400 | 0.88 | 1.26 | 1.56 | 1.68 | 1.74 | 740 | 300 | 1120 | 790 | 330 | 30 | 7.69 |
| 15 | | | 500 | 0.90 | 1.29 | 1.57 | 1.69 | 1.74 | 750 | 290 | 1140 | 720 | 320 | 20 | 7.68 |
| 16 | | 20 Times | W/O Annealing | 0.80 | 1.23 | 1.57 | 1.69 | 1.74 | 650 | 360 | 1020 | 870 | 150 | 40 | 7.7 |
| 17 | | | 400 | 0.92 | 1.30 | 1.58 | 1.70 | 1.74 | 820 | 320 | 1300 | 770 | 530 | 12 | 7.7 |
| 18 | | | 500 | 0.99 | 1.34 | 1.60 | 1.71 | 1.78 | 850 | 290 | 1550 | 710 | 840 | 8 | 7.7 |
| 19 | Sr—B—P—O (Stock Liquid No. 3) | 20 Times | 400 | 1.88 | 1.26 | 1.56 | 1.68 | 1.74 | 770 | 320 | 1290 | 800 | 490 | 10 | 7.72 |
| 20 | Y—B—P—O (Stock Liquid No. 4) | Stock Liquid Itself | 400 | 0.72 | 1.11 | 1.46 | 1.60 | 1.67 | 580 | 320 | 1020 | 810 | 210 | 17 | 7.64 |
| 21 | Y—B—P—O (Stock Liquid No. 5) | Stock Liquid Itself | 400 | 0.72 | 1.11 | 1.48 | 1.62 | 1.68 | 590 | 320 | 1010 | 800 | 200 | 24 | 7.67 |

TABLE 5

| Test Piece No. | Coating Liquid: Composition of Stock Liquid (Stock Liquid No.) | Coating Liquid: Dilution Ratio | Annealing Temp. (° C.) (In Air, Heating for 30 min.) | Static Magnetic Field Characteristic (T): $B_{1k}$ | $B_{2k}$ | $B_{5k}$ | $B_{8k}$ | $B_{10k}$ | Max. Magnetic Permeability (μm) | Coercive Force (A/m) | Alternating Magnetic Field Characteristic (1.0 T/800 Hz) (kW/m³): Total Loss Pc | Hysteresis Loss Ph | Eddy Current Loss Pe | Specific Resistance (ρΩm) | Density (×10³ kg/m³) |
|---|---|---|---|---|---|---|---|---|---|---|---|---|---|---|---|
| Comp. Ex. C6 | P—O (Stock Liquid No. C1) | 20 Time | 400 | 0.65 | 1.09 | 1.46 | 1.60 | 1.66 | 760 | 340 | 2160 | 900 | 1260 | 6 | 7.7 |
| C7 | B—P—O (Stock Liquid No. C2) | 20 Times | 400 | 0.78 | 1.17 | 1.50 | 1.63 | 1.69 | 650 | 320 | 3140 | 800 | 2340 | 3 | 7.68 |
| C8 | B—P—O (Stock Liquid No. C3) | 20 Times | 400 | 0.80 | 1.16 | 1.47 | 1.60 | 1.67 | 690 | 330 | 3110 | 800 | 2310 | 3 | 7.65 |

TABLE 5-continued

| Test Piece No. | Coating Liquid: Composition of Stock Liquid (Stock Liquid No.) | Coating Liquid: Dilution Ratio | Annealing Temp. (° C.) (In Air, Heating for 30 min.) | Static Magnetic Field Characteristic (T): $B_{1k}$ | $B_{2k}$ | $B_{5k}$ | $B_{8k}$ | $B_{10k}$ | Max. Magnetic Permeability (μm) | Coercive Force (A/m) | Alternating Magnetic Field Characteristic (1.0 T/800 Hz) (kW/m³): Total Loss Pc | Hysteresis Loss Ph | Eddy Current Loss Pe | Specific Resistance (ρΩm) | Density (×10³ kg/m³) |
|---|---|---|---|---|---|---|---|---|---|---|---|---|---|---|---|
| C9 | B—P—O (Stock Liquid No. C4) | 20 Times | 400 | 0.60 | 0.96 | 1.36 | 1.52 | 1.59 | 500 | 340 | 3360 | 800 | 2560 | 3 | 7.61 |
| C10 | Mg—B—P—O (Stock Liquid No. C5) | 20 Times | 400 | 0.57 | 1.04 | 1.48 | 1.60 | 1.67 | 600 | 320 | 2160 | 800 | 1360 | 6 | 7.7 |

Note that the magnetic characteristics were examined in the following manner. The static magnetic filed characteristics were measured with a DC self-recording magnetic-flux meter, which was made by TOEI KOGYO Co., Ltd. and had a model number "MODEL-TRF." The alternating magnetic field characteristics were measured with an AC B-H curve tracer, which was made by IWASAKI TSUSHINKI Co., Ltd. and had a model number "SY-8232." In the alternating magnetic characteristics recited in Tables 4 and 5, the iron loss was measured when the powder magnetic cores (or test pieces) were put in a magnetic field whose frequency was 800 Hz and magnetic flux density was 1.0T. Moreover, in Tables 4 and 5, the magnetic flux densities in the static magnetic field specify the magnetic flux densities which were produced when the strength of the magnetic filed was varied in the order of 1, 2, 5, 8 and 10 kA/m sequentially, and are recited in the respective tables' columns designated with $B_{1k}$, $B_{2k}$, $B_{5k}$, $B_{8k}$ and $B_{10k}$ respectively. The coercive force bHc was a value obtained from a magnetization curve produced in a magnetic curve whose maximum strength was 2 kA/m. The density was measured by an Archimedes method. Note that the maximum permeability was expressed by μm.

When the respective measurement results on the examples are observed, in all of the test pieces, the more concentrated the concentration of the coating liquid is, the more the specific resistance enlarges, and the iron loss is reduced. Moreover, when the annealing temperature is high, the specific resistance decreases so that the eddy current loss tends to increase, however, the residual strain is reduced contrarily so that the hysteresis loss is reduced. As a result, it is understood that, depending on the concentration of the coating liquid, it is possible to reduce the iron loss as a whole.

At present, it has not been cleared yet on the quantitative relationship between the concentration of the coating liquid and the thickness, and the like, of the insulation film. However, the more concentrated the concentration of the coating liquid is, the thicker the thickness of the insulation film is. Accordingly, this phenomenon is believed to result in the above-described advantages. For example, when Test Piece No. 14 was measured for the thickness of the insulation film by using a TEM (i.e., transmission electron microscope), it was found to fall in a range of from 20 to 30 nm.

Moreover, the measurement results of the examples are compared with those of the comparative example. When the specific resistances were at the same level with each other, the test pieces of the examples produced larger magnetic flux densities than those of the comparative examples did. In addition, when the magnetic flux densities were at the same level with each other, the test pieces of the examples exhibited larger specific resistances than those of the comparative examples did. As a result, in the examples, the iron loss, particularly the eddy current loss, was reduced as well.

Unless the insulation film is made of a magnetic material, it is inevitable that the specific resistance and magnetic flux density of powder magnetic cores are in a trade-off relationship. However, the relationship in the examples is more favorable than that in conventional ones. Specifically, in the examples, both of the specific resistance and magnetic flux density are in such a relationship that they are larger than conventional ones. As such an example, FIG. 1 illustrates the relationship between the specific resistance ρ (μΩm) and the magnetic flux density $B_{10k}$ (T). Note that the data plotted in FIG. 1 belong to the examples according to the present invention and comparative examples set forth in Tables 4 and 5.

The straight line shown in FIG. 1 is expressed by the following equation: $B_{10k}+0.2\log_{10}\rho=1.9$. Note that the data exhibited by the test pieces of the examples exist in a region above the straight line, i.e., $B_{10k}+0.21\log_{10}\rho \geqq 1.9$.

Having now fully described the present invention, it will be apparent to one of ordinary skill in the art that many changes and modifications can be made thereto without departing from the spirit or scope of the present invention as set forth herein including the appended claims.

What is claimed is:

1. An insulation film comprising:

a first element comprising boron (B), phosphorous (P), oxygen (O) and iron (Fe); and a second element being capable of generating cations whose hexa-coordinated ion radius is 0.073 nm or more, and which are bivalent or more.

2. The insulation film set forth in claim 1, wherein said second element is at least one element selected from the group consisting of alkaline-earth metal elements and rare-earth elements (R.E.).

3. The insulation film set forth in claim 2, wherein said alkaline-earth metal element is either calcium (Ca) or strontium (Sr), and said rare-earth element is Atrium (Y).

4. The insulation film set forth in claim 1, wherein said first element makes a network former, said second element makes a network modifier, and said insulation film is a glassy insulation film formed of the network former and the network modifier.

5. The insulation film set forth in claim 1, wherein a mating member to be covered with the insulation film is composed of Fe mainly; and said second element is an element whose standard formation energy of oxide is negatively greater than that of phosphorous oxide ($P_2O_5$).

6. The insulation film set forth in claim 1 covering a surface of a magnetic material.

7. The insulation film set forth in claim 6, wherein said magnetic material is a magnetic powder whose major component is iron (Fe).

8. The insulation film set forth in claim 6 whose thickness falls in a range of from 10 to 100 nm.

9. The insulation film set forth in claim 1 whose heat resistant temperature is 400° C. or more.

10. A process for producing an insulation film, comprising:

contacting a mating member with a coating treatment liquid in which a compound and/or salt comprising an element capable of generating cations whose hexa-coordinated ion radius is 0.073 nm or more, and which are bivalent or more, is mixed with boric acid and phosphoric acid to make a solution;

drying the mating member after the contacting step; and forming the insulation film of claim 1 on a surface of the mating member.

11. The process for producing an insulation film set forth in claim 10, wherein said compound and/or salt comprises an alkaline-earth metal element and/or rare-earth element.

12. The process for producing an insulation film set forth in claim 10, wherein said mating member is a magnetic material.

13. A powder for a magnetic core, comprising:

a magnetic powder; and an insulation film covering a surface of the magnetic powder, wherein a first element comprising B, P, O and Fe, and a second element capable of generating cations whose hexa-coordinated ion radius is 0.073 nm or more, and which are bivalent or more, are requisite constituent elements.

14. A powder magnetic core, formed by pressuring a magnetic core powder whose surface is covered with an insulation film, wherein a first element comprising B, P, O and Fe, and a second element capable of generating cations whose hexa-coordinated ion radius is 0.073 nm or more, and which are bivalent or more, are requisite constituent elements.

15. A process for producing a powder magnetic core, comprising:

contacting a magnetic powder with a coating treatment liquid in which a compound and/or salt comprising an element capable of generating cations whose hexa-coordinated ion radius is 0.073 nm or more, and which are bivalent or more, is mixed with boric acid and phosphoric acid to make a solution;

drying the magnetic powder after the contacting step;

forming an insulation film on a surface of the magnetic powder; and producing the powder magnetic core of claim 14.

16. The powder magnetic core set forth in claim 14 whose specific resistance ρ is 5 μΩm or more and coercive force bHc is 350 A/m or less.

17. The powder magnetic core set forth in claim 14 whose specific resistance ρ (μΩm) and magnetic flux density $B_{10k}$ (T) produced in a magnetic field whose strength is 10 kA/m, satisfy the following inequality:

$$B_{10k} \geqq -0.2\log_{10}\rho + 1.9.$$

18. A process for producing a powder magnetic core, comprising:

filling a magnetic core powder in a forming mold, a surface of the magnetic core powder being covered with an insulation film, wherein a first element comprising B, P, O and Fe, and a second element capable of generating cations whose hexa-coordinated ion radius is 0.073 nm or more, and which are bivalent or more, are requisite constituent elements;

forming the magnetic core powder within the forming mold by pressurizing; and producing the powder magnetic core of claim 14.

19. The process for producing a powder magnetic core set forth in claim 18, wherein said filling step is a step in which the magnetic core powder is filled in said forming mold in which a higher fatty acid-based lubricant is applied to an inner peripheral surface; and said forming step is a warm high-pressure forming step in which a metallic soap film is generated between the magnetic core powder and the inner surface of the forming mold.

20. The process for producing a powder magnetic core set forth in claim 19, wherein the magnetic core powder is composed of Fe mainly;

the higher fatty acid-based lubricant is at least one member selected from the group consisting of lithium stearate ((St.)Li), calcium stearate ((St.)Ca) and zinc stearate ((St.)Zn); and the metallic soap film comprises iron stearate ((St.)Fe).

21. The process for producing a powder magnetic core set forth in claim 18, wherein an annealing step is further carried out in which a green compact produced after said forming step is annealed.

22. The process for producing a powder magnetic core set forth in claim 21, wherein the green compact comprises a powder in which Fe is a major component; and said annealing step is a step in which the green compact is cooled gradually after it is heated to 300° C. or more.

23. The insulation film set forth in claim 1, wherein the hexa-coordinated ion radius is defined by Shannon, R. D.

24. The process set forth in claim 10, wherein the hexa-coordinated ion radius is defined by Shannon, R. D.

25. The powder set forth in claim 13, wherein the hexa-coordinated ion radius is defined by Shannon, R. D.

26. The process set forth in claim 15, wherein the hexa-coordinated ion radius is defined by Shannon, R. D.

27. The powder magnetic core set forth in claim 14, wherein the hexa-coordinated ion radius is defined by Shannon, R. D.

28. The process set forth in claim 18, wherein the hexa-coordinated ion radius is defined by Shannon, R. D.

* * * * *

UNITED STATES PATENT AND TRADEMARK OFFICE

CERTIFICATE OF CORRECTION

PATENT NO. : 7,029,769 B2
APPLICATION NO. : 10/389978
DATED : April 18, 2006
INVENTOR(S) : Shin Tajima et al.

It is certified that error appears in the above-identified patent and that said Letters Patent is hereby corrected as shown below:

Column 25, line 3, "Atrium (Y)" should read --yttrium (Y)--

Signed and Sealed this

Eighth Day of August, 2006

JON W. DUDAS
*Director of the United States Patent and Trademark Office*